US005816155A

United States Patent [19]

Stephan

[11] Patent Number: 5,816,155

[45] Date of Patent: Oct. 6, 1998

[54] SHEET GUIDING DEVICE FOR PRINTING PRESSES

[75] Inventor: Günter Stephan, Wiesloch-Baiertal, Germany

[73] Assignee: Heidelberger Druckmaschinen AG, Heidelberg, Germany

[21] Appl. No.: 857,133

[22] Filed: May 15, 1997

Related U.S. Application Data

[63] Continuation of Ser. No. 595,103, Feb. 1, 1996, abandoned.

[30] Foreign Application Priority Data

Feb. 1, 1995 [DE] Germany ..... 195 03 110.5

[51] Int. Cl.[6] ..... B65H 29/24

[52] U.S. Cl. ..... 101/232

[58] Field of Search ..... 101/232, 233

[56] References Cited

U.S. PATENT DOCUMENTS

| | | | |
|---|---|---|---|
| 3,622,058 | 11/1971 | Vits | 226/7 |
| 3,684,081 | 8/1972 | Matsuo | 198/184 |
| 4,029,009 | 6/1977 | Kuhn et al. | 101/231 |
| 4,099,463 | 7/1978 | Zimmermann et al. | 101/230 |
| 4,572,071 | 2/1986 | Cappel et al. | 101/183 |
| 5,243,909 | 9/1993 | DeMoore et al. | 101/420 |
| 5,419,256 | 5/1995 | Pollich | 101/233 |
| 5,488,905 | 2/1996 | Secor | 101/232 |
| 5,497,987 | 3/1996 | Henn et al. | 271/204 |
| 5,509,352 | 4/1996 | Kowalewski et al. | 101/232 |
| 5,546,858 | 8/1996 | Stephan | 101/232 |

FOREIGN PATENT DOCUMENTS

| | | |
|---|---|---|
| 3411029 | 10/1987 | Germany . |
| 4209067 | 9/1993 | Germany . |

*Primary Examiner*—Edgar S. Burr
*Assistant Examiner*—Amanda B. Sandusky
*Attorney, Agent, or Firm*—Herbert L. Lerner; Laurence A. Greenberg

[57] ABSTRACT

Sheet guiding device for a printing press having a guide surface member for guiding sheets includes blast air or suction nozzles provided in the guide surface member, the guide surface member being formed, as viewed in a sheet transport direction, successively of an entry region, a guide zone and an exit region, the nozzles provided in at least one of the entry and the exit regions of the guide surface member being suppliable selectively with suction or blast air in accordance with a type of printing material or stock to be processed, and the nozzles provided in the guide zone disposed between the entry region and the exit region of the guide surface member being suppliable with blast air, at least some of the nozzles being disposed so as to emit blast air substantially tangentially to a guide surface of the guide surface member.

10 Claims, 4 Drawing Sheets

20
20'
21
22
23
24
25
1
3
5
6
7
8
8'
9
9'
10
10'
11
12
13
14
15
17
19

SHEET GUIDING DEVICE FOR PRINTING PRESSES this is a continuation-in-part of application Ser. No. 08/595,103, filed Feb. 1, 1996, now abandoned.

BACKGROUND OF THE INVENTION

Field of the Invention

The invention relates to a sheet guiding device for printing presses having guide surface members for guiding sheets, nozzles to which blast air or suction air is applicable being provided in the guide surface members.

A sheet guiding device of this general type has become known heretofore from the published German Patent Document DE 34 11 029 C2. In this known sheet guiding device, an attempt has been made to achieve a reliable floating or suspended guidance of the sheets by having nozzles, which are in the form of bores disposed in the guide surface members perpendicularly thereto, constituting a predetermined part of the surface area of the respective guide surface members. A disadvantageous feature of this conventional sheet guiding device is that the nozzles are directed perpendicularly to the sheet which is to be guided. For example, blast air emerging from the nozzles strikes the sheet, must be deflected thereby with an application of forces, and then flows radially away 360° on all sides from the nozzle blast-air outlet location. The pulsing forces resulting from the deflection cause the sheet to flutter. In order to guide a sheet stably by means of these unstable and turbulent free jets from the nozzles, it is necessary to adjust the pulsing force with very delicate sensitivity to the particular printing material or stock. The supply pressure of the blown-in air must be only minimal. In order to maintain the entire sheet guiding region free of smearing, however, a high volumetric flow is required and, in order to generate such a flow, a quite specific part of the surface area in the guide plane must be formed of the nozzle bores.

Furthermore, in the device of the aforementioned published German patent document, the volumes of air flowing away from the nozzles, after having been deflected by the respective sheets, extend in a direction opposite to that of the like air volumes of the adjacent nozzles. These mutually oppositely directed volumes meet violently and generate around the nozzles regions having turbulence fields wherein the nozzle air swirls and the kinetic energy of the nozzle air is dissipated.

Because of the heavy turbulence, sheet transport is disrupted in these zones. The sheets are caused to flutter and vibrate, and the trailing edge thereof, especially, performs whiplike motions. The possibility of guiding a sheet printed on both sides thereof without smearing it thus exists, if at all, only at a low press speed and with considerable expenditure of time for adjusting the intrinsically unstable free jets of blast air. In order to be able to operate a printing press, however, the nozzles are acted upon by suction, and only with friction do they generate a sheet guidance which permits higher speeds of the printing press. If a sheet printed on both sides is to be processed, regions which must remain unprinted are required on the reverse side thereof. In these regions, the sucking bores can become active. Therebetween, it is then possible by means of blast air to prevent smearing of the printed sheets, because the sheet holding forces, respectively, are generated only by the sucking regions.

SUMMARY OF THE INVENTION

It is accordingly an object of the invention to provide a sheet guiding device for printing presses which avoids the disadvantages of the prior art and which assures reliable sheet travel for various kinds of printing material or stock, both in first-form and perfector or recto/verso printing, with minimal setup or make-ready times.

With the foregoing and other objects in view, there is provided, in accordance with the invention, a sheet guiding device for a printing press having a guide surface member for guiding sheets, comprising blast air or suction nozzles provided in the guide surface member, the guide surface member being formed, as viewed in a sheet transport direction, successively of an entry region, a guide zone and an exit region, the nozzles provided in at least one of the entry and the exit regions of the guide surface member being suppliable selectively with suction or blast air in accordance with a type of printing material or stock to be processed, and the nozzles provided in the guide zone disposed between the entry region and the exit region of the guide surface member being suppliable with blast air, at least some of the nozzles being disposed so as to emit blast air substantially tangentially to a guide surface of the guide surface member.

In accordance with another feature of the invention, at least some of the nozzles provided in the entry region are selectively suppliable with the blast or suction air.

In accordance with a further feature of the invention, at least some of the nozzles provided in the exit region are selectively suppliable with the blast or suction air.

In accordance with an added feature of the invention, the device includes adjustable-speed fans for supplying air to the nozzles.

In accordance with an additional feature of the invention, the device includes axial fans for supplying air to the nozzles, the axial fans being reversible with respect to the direction of rotation thereof.

In accordance with yet another feature of the invention, the device includes air supply chests for supplying air to respective locations of the printing press, and respective fans assigned to the air supply chests, the air supply chests, respectively, having a size adapted to air requirement at the respective location.

In accordance with yet a further feature of the invention, the guide surface of the guide surface member is occupied by an array of the nozzles having a distribution varying in density to suit the respective air requirement.

In accordance with yet an added feature of the invention, the distribution density of the nozzles is greatest in the middle of a travel path for the sheet and decreases towards an edge of the sheet travel path.

In accordance with yet an additional feature of the invention, the nozzles are slit nozzles directed to the outside of the sheet travel path.

In accordance with another feature of the invention, the respective nozzles are switchable between a suction-air mode and a blast mode by remote control.

In accordance with a further feature of the invention, the nozzles in the entry region of the guide surface member are switchable to the suction-air mode when the printing material being processed is light-weight.

In accordance with an added feature of the invention, the nozzles in the exit region of the guide surface member are switchable to the suction-air mode when the printing material being processed is light-weight.

In accordance with a concomitant feature of the invention, the respective nozzles are switchable to suction-air mode for sucking a respective sheet in a region of the guide surface located substantially centrally to a sheet guide path in one of the entry region and the exit region of the guide surface member.

An advantage of the invention is that, in the preferred operating mode, which is the blowing or blast air mode, due to the tangential air flow, the printing press is capable of guiding, reliably and without smearing, all types of printing materials or stock to be processed. This is accomplished by guiding the sheets on an air flow which, due to the tangential, similarly directed blowing of the nozzles is combined from a multiplicity of individual flows into one main flow having a uniform flow direction. This flowing air cushion,—because of its evenness and uniformity, is capable of guiding the sheet without touching the sheet guide members or baffles, thus without smearing, even after both sides of the sheets have been freshly printed. In particular, this is possible at all machine speeds and when reset or make-ready times are short, because time-consuming adaptation of the air flow to the printing material or stock and to the speed of the printing press is only very seldom necessary. To place a printing press which is selectively operated for one-sided or recto/verso printing into a reliable production-run status as rapidly as possible, or in other words with minimal reset and adjustment times even at the highest machine speeds, when contact-sensitive undersides of sheets are to be processed, the invention provides that, with one-sided printing, a readjustment or conversion of the sheet guidance be possible whereby, at problematic locations in the sheet travel, a suction mode takes place wherein the unprinted sides of the sheets of paper can come into contact with metal. In this case, such contact with metal does no harm and in fact can significantly shorten the press reset or make-ready time. The sheets of paper are guided cleanly and smoothly along the sheet metal of the sheet guiding device in such a case. The paper sheets experience a braking force in the process, which tautens them, so that in this way as well, the sheets can be transferred to the next impression cylinder without any formation of creases or air cushions.

The regions or sections of the printing press which can be acted upon by or are subjectible to suction are preferably located on all the sheet-guiding drums, because disruptions in sheet travel readily occur in regions thereof affected by centrifugal force. Examples thereof are the supply drum adjacent to the feeder, the transfer drums disposed between the printing units, and the delivery drum with which the delivery system takes over or accepts the sheets from the last printing unit. If additional transfer drums are built into the press, guide surface members should also be provided therewith as well so that, in problematic regions, they can be acted upon by suction. It is also possible to provide regions which can be acted upon by suction in the delivery system as well, for example, forward or in front of the sheet brake.

Advantageously, the exit regions of the guide surface members of the sheet-guiding drums preceding the impression cylinders are constructed so that they can be acted upon by suction. These drums may be transfer drums which are disposed between the impression cylinders of the various printing units. However, it is also possible for more than one sheet transport drum to be disposed between the impression cylinders. The sheet transport drum before or upstream of the first impression cylinder is a supply drum, which takes the sheet from the feeder and transports it further onto the impression cylinder. It is also possible, however, for a further transport drum to be provided in this region. Clean sheet guidance is especially important in the case of sheet-guiding drums preceding the impression cylinders, because the placement of the sheet on the impression cylinders and, hence, the quality of the printing depend upon clean sheet guidance. Due to the action of suction air in these regions, the sheet, upon the transfer thereof to the impression cylinder, experiences an additional advantageous automatic stabilization, which tautens the sheet and thus serves to apply the sheet smoothly to the impression cylinder. This result in a considerable simplification of the adaptation of the printing press to the particular type of printing material or stock, especially when contact-sensitive undersides of sheets are involved.

The entry regions of the guide surface members of the sheet-guiding drums can also be selectively acted upon by suction air. This is advantageous in the event of a stoppage of a printing press, for example, due to an emergency stop or a slow forward rotation of the press in the typing mode. At the time of such a press stoppage or slow forward rotation, if the end of the sheet is located in the entry region of the guide surface member of a sheet-guiding drum, then as a rule the rear or trailing end of the sheet faces upwardly, and the press stoppage or a very slow forward rotation can cause the end of the sheet to drop downwardly, resulting in a creasing of the sheet. Printing presses heretofore known in the prior art must first reject such sheets in the typing mode, or else the sheets must be removed before printing can be resumed. By the imposition of suction air in the entry region of the guide surface members of the sheet-guiding drums, the end of the sheet is reliably held and, after a press stop or a slow further rotation of the printing press, it is possible to continue printing immediately, because the ends of the sheets do not drop downwardly.

A further feature of the invention provides for the air supply to be effected via axial fans having a selectively reversible direction of rotation. This ensures the accomplishment, in a very simple manner, of a switchover of the desired sections or locations of the printing press.

The air supply to the nozzles is preferably accomplished via adjustable-speed fans. In this manner, in the blowing or blast mode, the floating or suspension guidance can be adjusted, while in the suction mode, it is possible to adjust on the guide surface members the frictional force of the sheet adapted to the particular paper involved. Moreover, in the suction mode, the possibility exists of removing just enough air by suction so that contact between the sheet and the guide member or baffle does not yet occur.

It is possible to have the desired air act upon relatively large nozzles individually by means of fans, or an air supply can be provided wherein individual regions or portions of the air supply are made effective via air supply chests or boxes. In this regard, at least one subdivision of the guide surface members into regions which are acted upon selectively with blowing or suction air, and regions of the guide surface members which are preferably acted upon only in the blowing air mode is required. Naturally, a further subdivision is also possible, depending upon how strong the action of the air in a certain region of a guide surface member should be. The advantage of the air supply chests or boxes is that many nozzles can be supplied by means of one air supply element. For a relatively large number of nozzles, for example, correspondingly strong axial fans can be used. Due to the subdivision, it is nevertheless possible to supply air variably to the individual regions of the guide surface members. It is therefore proposed that an axial fan be assigned to each blower chest, and that the size of the air supply chests be adapted to the air requirement of the respective region.

A further feature provides that the guide surface members be arrayed with a varying number of nozzles or a varying density thereof per unit area to suit or match the particular air requirement. For example, it is thus possible for the entry and exit regions of the guide surface members to be provided with a greater density of nozzles per unit area or a higher degree of occupancy by nozzles in the respective area, while the guide zones located between those regions have a lower nozzle density or degree of occupancy per unit area. It is also possible for the nozzle density or degree of areal occupancy to be provided greatest in the middle of the sheet travel path and to decrease toward the edge thereof. This is especially expedient if the nozzles are slit nozzles directed towards the outside of the sheet travel path. Then, the corresponding air flow is generated in the middle of the sheet travel path and need merely be maintained towards the edge; that is, as many nozzles as in the middle of the sheet travel path are no longer needed.

Advantageously, all the sections of the printing press which can be acted upon by air are adjusted by remote control. The switch-over to the suction mode by remote control is especially time-saving when the press is to be converted from perfecter or second-side printing to one-side printing or to the use of problematic types of paper. This can be performed very simply by means of electronic triggering of the axial fans or other fans.

Other features which are considered as characteristic for the invention are set forth in the appended claims.

Although the invention is illustrated and described herein as embodied in a sheet guiding device for printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

FIGS. 8 and 8*a* are respective cross-sectional and plan views of a slit nozzle in accordance with the invention.

DESCRIPTION OF THE PREFERRED EMBODIMENTS

Figure 1:
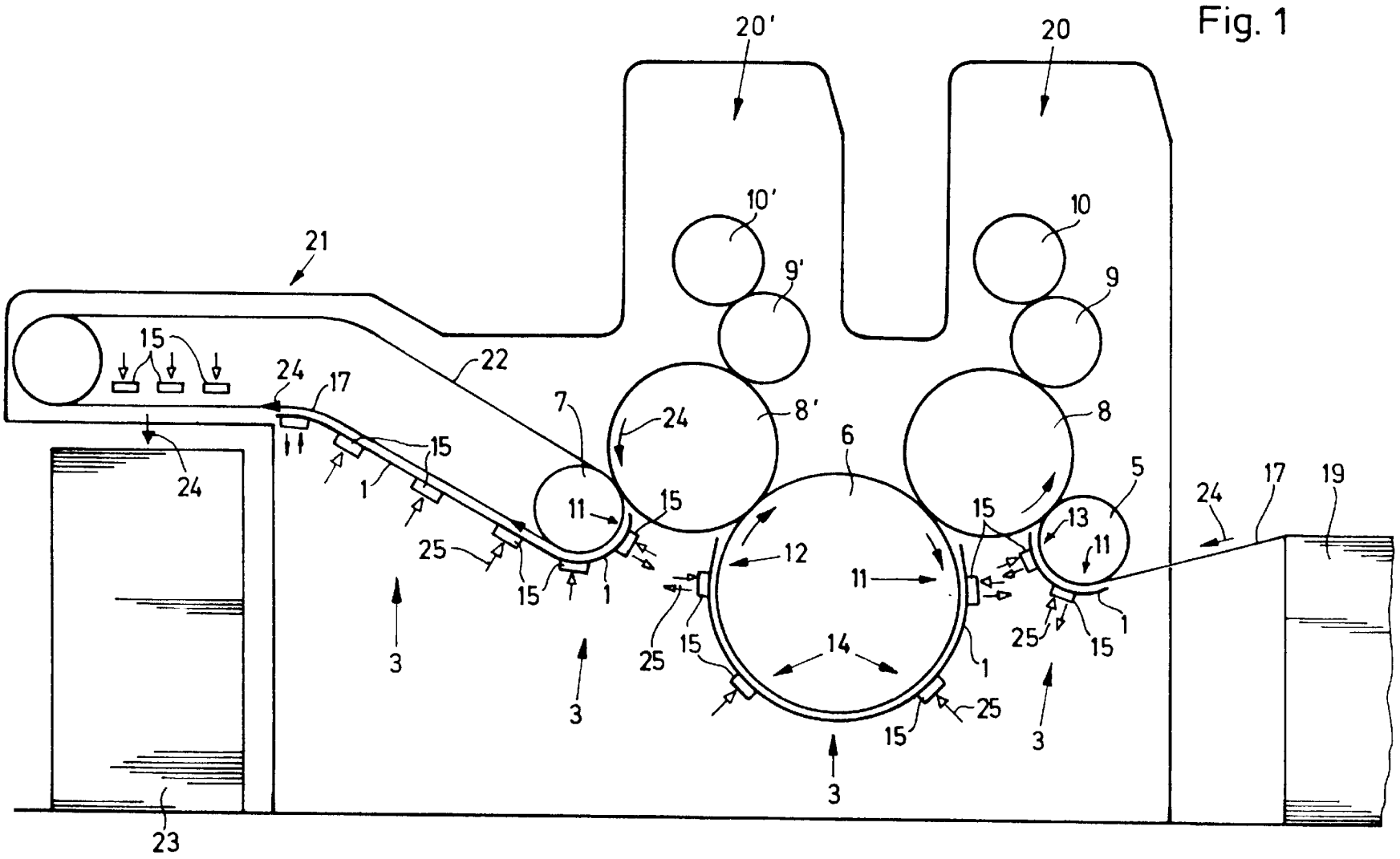
FIG. 1 is a diagrammatic side elevational view of a printing press provided with the sheet guiding device according to the invention.
Figure 2:
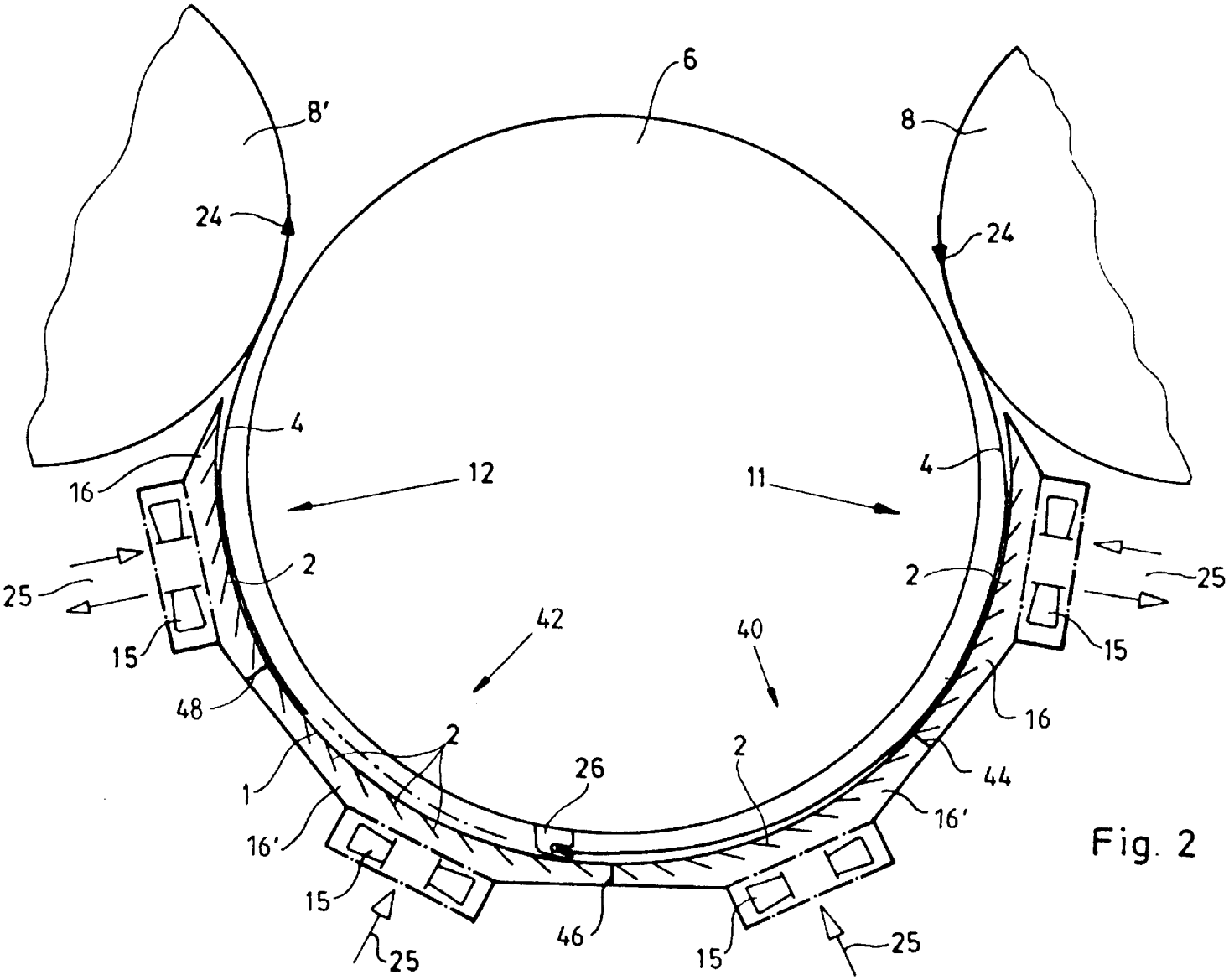
FIG. 2 is an enlarged fragmentary view of FIG. 1 showing a guide surface according to the invention for a transfer drum of the printing press.

Referring now to the drawings and, first, particularly to FIG. 1 thereof, there is shown therein diagrammatically a printing press with an exemplary embodiment of a sheet guiding device according to the invention. In the interest of simplicity, only two printing units 20 and 20' of the printing press are shown; generally, such a printing press has four printing units or more, however. Each printing unit 20, 20' has an impression cylinder 8, 8', a rubber blanket cylinder 9, 9', and a plate cylinder 10, 10', as well as non-illustrated inking units. Between the printing units 20 and 20', a transfer drum 6 assures the further passage of the sheets 4 to be printed. If a printing press has several printing units, transfer drums 6 are always disposed between each two printing units. Naturally, it is also possible for a plurality of sheet feeding drums to be provided instead of the single transfer drum 6. In the illustrated printing press, a sheet travel path 17 is shown with accompanying arrows 24 indicating the sheet travel direction. The sheets 4 are removed from a feed pile 19 and forwarded, by means of a conventional non-illustrated feeder device, to a feeder drum 5 having non-illustrated grippers with which it transfers the sheets 4 to an impression cylinder 8 for printing. From the impression cylinder 8, the sheet 4 is accepted by grippers 26 (FIG. 2) of the transfer drum 6 and delivered to a further impression cylinder 8', so that a further printing operation can be performed on the sheet 4. In the illustrated printing press, the impression cylinder 8' transfers the sheet 4 to a delivery drum 7 of a delivery system 21. The delivery drum 7 is a transfer drum for gripper bars which are disposed on a delivery chain 22 and which transport the accepted sheets 4 to the end of the delivery system 21, whereat the sheets 4 are deposited on a delivery pile 23.

Additional sheet guidance is required in sections 3 of the printing press so that the sheets 4 will be transported cleanly and, above all, transferred to the impression cylinders 8 and 8' so as to lie smoothly thereon. In this regard, guide surface members or deflectors 1 having a number of preferably slitlike nozzles 2 are disposed in the sections 3. These nozzles are not shown in FIG. 1 but can be seen, for example, at the transfer drum 6 in FIG. 2. The nozzles 2 are constructed so that at least some thereof feed blast air substantially tangentially to the surface of the guide surface member 1 in the region formed between the sheet 4 and the guide surface member 1. The air flow and the surface of the guide surface member 1 define an angle therebetween which may, for example, be between 0.1° and 30°. The arrangement of the nozzles 2 and the direction in which they blow are also preferably selected so that the air flows of adjacent nozzles groups are superimposed into a total flow having substantially parallel flow lines. The guide surface member 1 at the transfer drum 6 has a total of four nozzle regions 11, 12, 40 and 42, divided by partitions 44, 46 and 48, and acted upon with air by a respective axial fan 15. The nozzle regions 11, 12, 40 and 42 are formed of a plurality of nozzles 2, which are disposed behind one another as seen in the viewing direction of FIG. 2. The arrows 25 indicate the possible directions in which the respective axial fans 15 blow. The sheet 4 which has been accepted or taken over by the transfer drum 6 from the impression cylinder 8 by means of a row of grippers 26 is transported onwardly to the impression cylinder 8'.

When the sheet guiding device is in the blowing or blast mode, the sheet 4 experiences a floating or suspension guidance wherein it is guided between the transfer drum 6 and the guide surface member 1 without contacting the surface of the guide surface member 1. Such a floating guidance is necessary in perfector printing, for example, because neither side of the sheet 4 must be allowed to become smeared at the transfer drum 6 or at the guide surface members 1.

If the press is being operated in first-form or recto printing mode, however, the underside of the sheet 4 is unprinted, and floating guidance is unnecessary. Thus, in critical sections 3 of the printing press, guidance of the sheets 4 along the guide surface members 1 may be selected, so as to achieve the aforementioned shortening of the reset or make-ready time. To that end, the axial fans 15 are switched to the suction mode in the entry region 11 and exit region 12 of a respective corresponding guide surface member 1. The sheet 4 can thereby slide along the guide surface members 1 in the regions 11 and 12, and friction forces can arise between the sheet 4 and the guide surface of the guide surface members 1. The sheet 4 is consequently held in the entry region 11 so that when the press is in a slow operating mode or is stopped, the sheet will not drop downwardly at the rear or trailing end thereof, so that the sheet 4 does not become creased thereby. The suction mode in the exit region 12 also leads to a tautening or stretching of the sheet 4, so that labile or soft papers, especially those with a low weight per unit of surface area, such as Bible paper, for example, can be surrendered, i.e., transferred, to the impression cylinder 8 even at maximum speed without producing waviness or trapped air bubbles. In this way, even problematic papers can be printed with high quality and at maximum speed, while minimal machine reset times are maintained. Guidance of the sheet 4 along the guide surfaces of the guide surface members 1 in the exit region 12 can also be helpful even with less problematic papers, for example, if the printing press is running correspondingly fast and, thereby, great centrifugal forces are exerted upon the sheet 4 which can drive it outwardly and consequently cause a fluttering of the sheet 4. In this case as well, the holding or retention forces generated by the aforedescribed guidance in both the air blowing and the suction mode and exerted upon the sheet 4 along the guide surfaces of the guide surface members 1 can serve to apply the sheet 4 cleanly to the impression cylinder 8'.

It is believed to be apparent from FIG. 1 that axial fans 15 are also disposed at the feeder drum 5 in the entry region 11 and the exit region 13, respectively, of the respective guide surface members 1, and can apply suction air to the nozzles 2 so as to permit taut sheet guidance there as well, and thereby ensuring that the sheet 4 lies properly on the impression cylinder 8. An axial fan 15 is also provided at the delivery drum 7 and assures that an end of a sheet in this region is reliably guided and cannot fall downwardly if the press should stop, which could consequently cause a creasing of the sheet 4 and render it unuseable. Further apparent is how additional axial fans 15 for sheet guidance can be disposed in the section 3 of the delivery system 21 and can serve, respectively, to feed the sheet 4 reliably to the delivery pile 23, and to assure that the sheets are acted upon with blown or blast air above the delivery pile 23 in such a manner that they are deposited quickly on the delivery pile 23.

Figure 3:
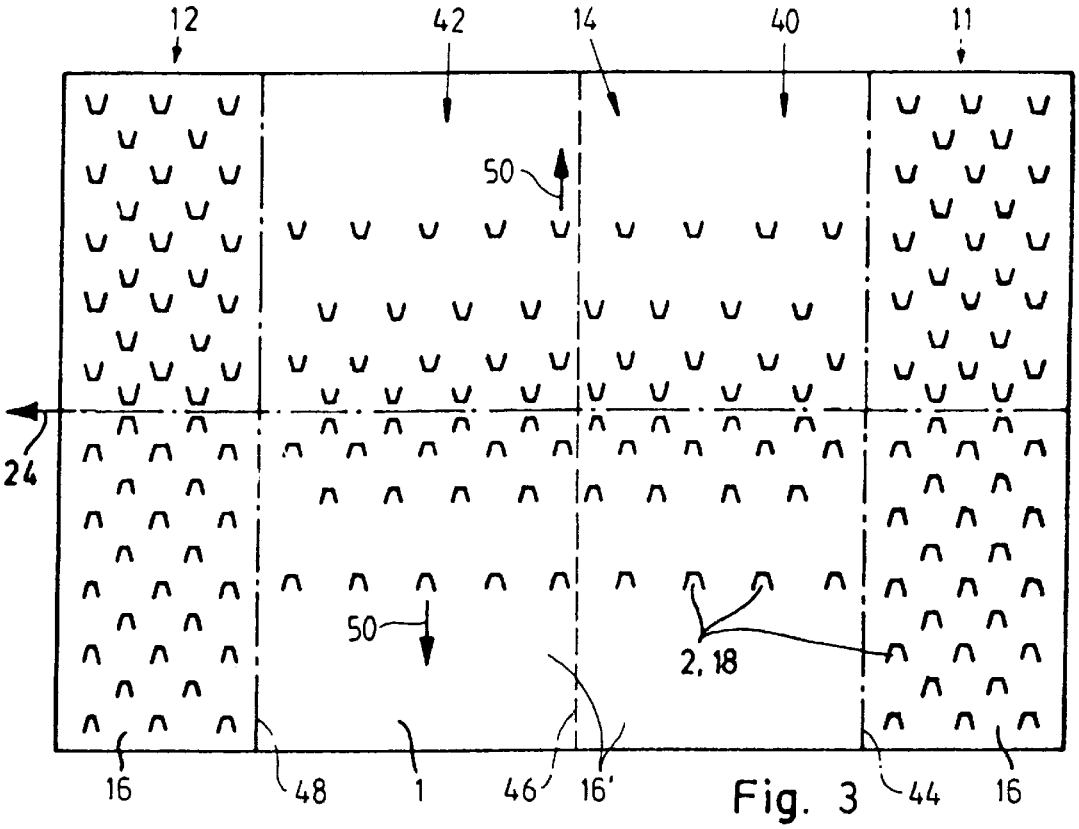
FIG. 3 is a developed top plan view of a sheet guiding device formed of air supply boxes in accordance with the invention.

FIG. 3 shows a guide surface member 1 having nozzles 2 which are acted upon with air by means of air supply boxes or chests 16 and 16'. The guide surface member 1 is shown in a plan view in FIG. 3, with the partitions 44, 46 and 48 represented by broken lines or in phantom providing for a subdivision thereof into the various air supply boxes or chests 16 and 16'. The density per unit of surface area of the nozzles 2 which are embodied as slit nozzles 18 is preferably varied. In the entry region 11, for example, two air supply boxes or chests 16 are provided, which have a relatively high density of nozzles 2 per unit of surface area. They are followed by a guide zone 14 having an areal density of nozzles 2 which is greater in a middle region thereof than at the edges thereof. This guide zone 14, for example, corresponds to the nozzle regions 40 and 42, wherein an application of blown or blast air is adequate for any operating mode of the printing press. The guide zone 14 is followed in the sheet travel direction 24 by the exit region 12 which has a higher density of nozzles and wherein relatively strong holding or retention forces must act upon the sheet 4 in the suction-air operating mode.

Figure 4:
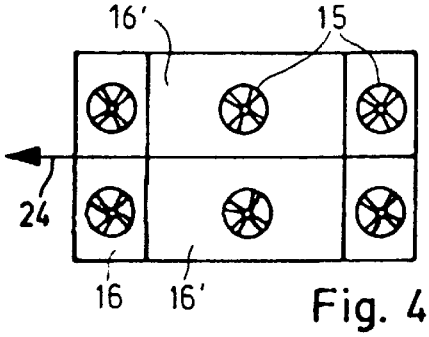
FIGS. 4, 5 and 6 are different arrangements of axial fans in the air supply boxes.
Figure 5:
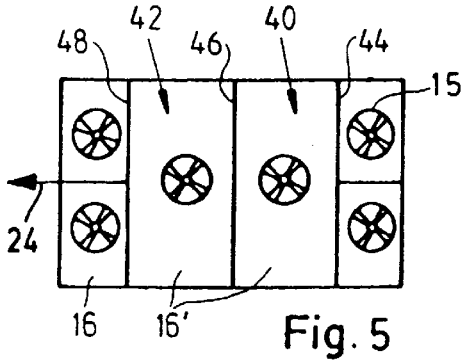

FIG. 4 shows how axial fans 15 can be associated with the air supply chests 16 and 16' shown in FIG. 3. It is also possible, however, to arrange the air supply chests 16 and 16' and the axial fans 15 in the manner shown in FIG. 5. This arrangement is substantially equivalent to the arrangement of air supply chests with the partitions 44, 46 and 48 shown in FIG. 2.

Figure 6:
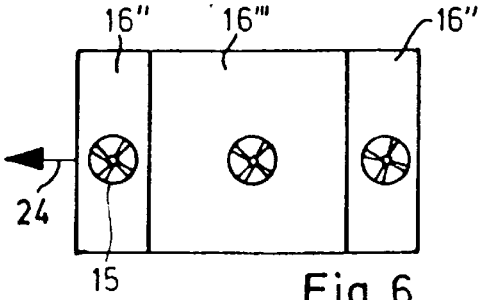
Figure 7:
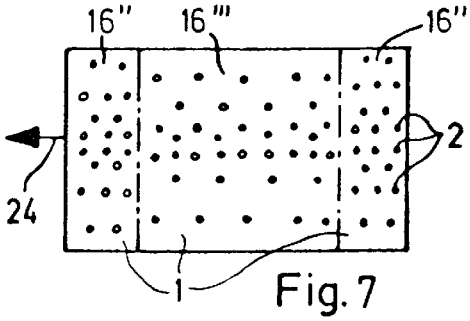
FIG. 7 is a nozzle array in the air supply boxes.

If a lesser amount of air is required, one of the subdivisions can be dispensed with, so that only one blower chest 16", respectively, is provided in the entry region 11 and in the exit region 12, and a large blower chest 16'" is provided in the guide zone 14, as shown in FIG. 6. The nozzle array is formed accordingly and is represented in FIG. 7.

Figure 8:
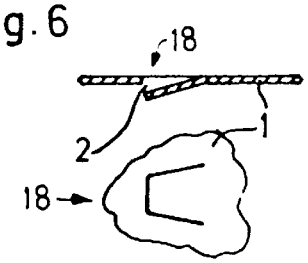

FIG. 8 shows the preferred embodiment of the nozzles 2 which has already been indicated in FIG. 3. This involves slit nozzles 18, which can be stamped in a relatively simple manner into the sheet metal of the guide surface members 1. In the arrangement shown in FIG. 3, the direction of blowing is directed outwardly as represented by arrows 50, which tautens the sheet 4 transversely or crosswise to the travel direction thereof. To that end, it is necessary for two strong, outwardly directed air flows to be formed in the middle and move towards the side of the sheet 4, those air flows, as they travel towards the outside, being maintainable by means of a lesser number of nozzles 2, 18.

Figure 9:
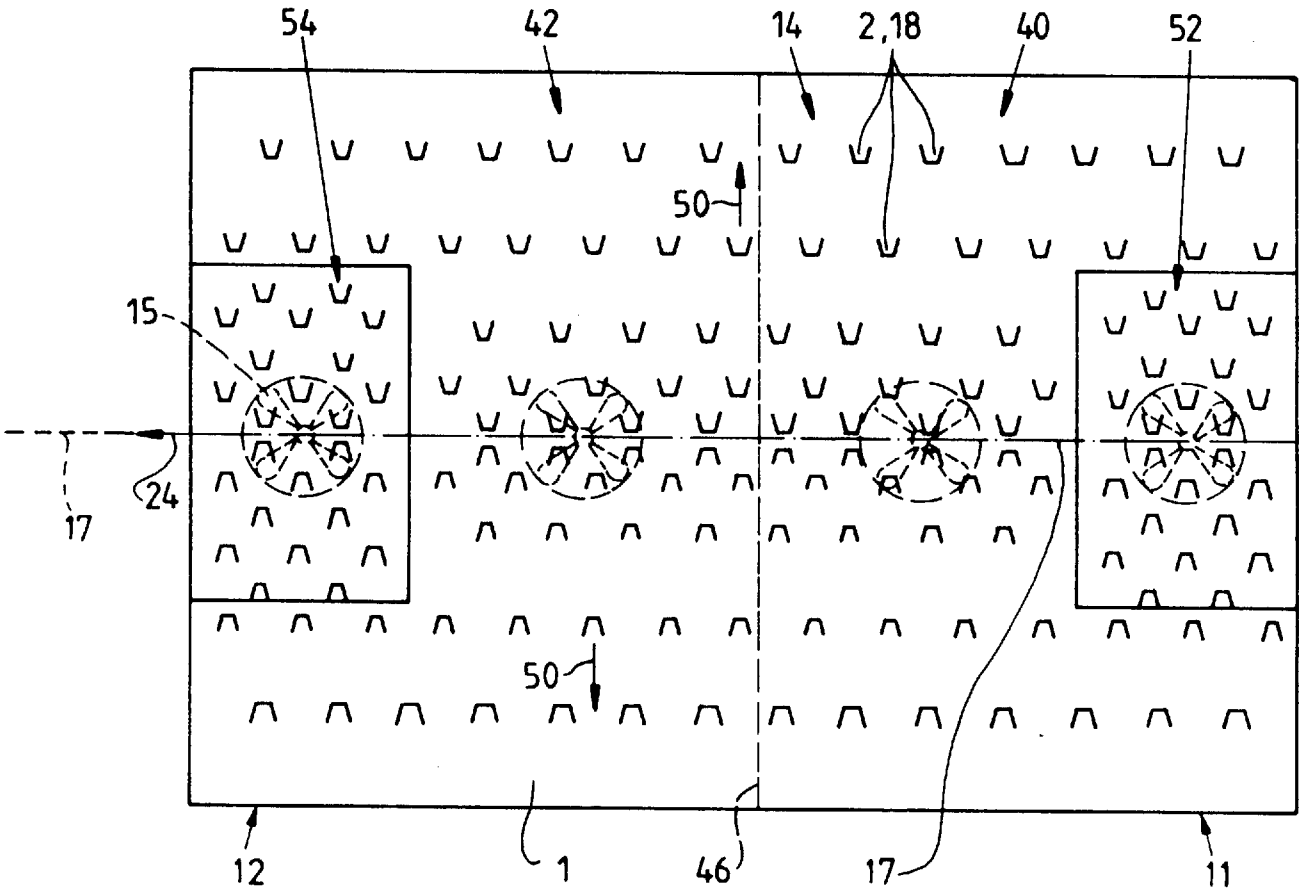
FIG. 9 is a view similar to that of FIG. 3 showing a guide surface wherein sucking of the sheet occurs in sections disposed centrally to the longitudinal axis of the sheet.

In a preferred embodiment of the invention shown in FIG. 9, nozzle regions 52 and 54 having nozzles, which are switchable between the blowing or blast mode and the suction mode in accordance with the type of printing material or stock to be processed, are provided in the entry region 11 and/or in the exit region 12 of the guide surface member 1. The other nozzles of the guide surface member 1 in this embodiment of the invention are preferably operated in the blowing or blast mode. Each of the nozzle regions 52 and 54 preferably has a respective fan 15 associated therewith, and these regions 52 and 54 are preferably disposed centrally to the sheet travel path 17 and have a width which is less than that of the smallest sheet format or size processable by the printing press.

The exemplary embodiments merely illustrate possibilities for constructing the sheet guiding device of the invention; other constructions with different nozzle arrays and, if necessary or desirable, other blowing or blast directions are also conceivable within the scope of the invention. Instead of the axial fans 15, a central air supply with blown or blast air and suction air or different types of fans may also be used.

I claim:

1. A sheet guiding device for guiding sheets in a printing press, comprising:

a guide surface member having a guide surface;

said guide surface having blast air or suction slit nozzles formed therein, said nozzles directed crosswise to a sheet travel path;

said guide surface member being formed successively of an entry region, a guide zone and an exit region as viewed in a sheet transport direction;

air supply chests for supplying air to respective regions of said guide surface member, and respective fans assigned to said air supply chests, said air supply chests, respectively, having a size adapted for air requirements at said respective regions and said air supply chests acting selectively in individual regions;

said nozzles in said guide zone supplying blast air and said nozzles in said entry region and said exit region supplying blast air if the printing press is operating in a perfector mode for preventing the sheets from contacting said guide surface;

said nozzles in at least one of said entry and said exit regions supplying suction air if the press is operating in a recto printing mode for providing frictional forces between the sheets and said guide surface member; and at least some of said nozzles emitting blast air substantially tangentially to said guide surface, said nozzles disposed on said guide surface in an array having a distribution varying in density and said distribution density of said nozzles is greatest in a middle of the travel path for the sheets and decreases towards an edge of the sheet travel path.

2. Device according to claim 1, wherein said nozzles in said entry and said exit regions are supplied with suction air when the printing material being processed requires a change in the frictional force between the sheets and said guide surface for reliably feeding the sheets.

3. Device according to claim 1, including a reversible fan connected to at least some of said nozzles provided in said entry region for selectivley supplying blast or suction air.

4. Device according to claim 1, including a reversible fan connected to at least some of the nozzles provided in said exit region for selectively supplying blast or suction air.

5. Device according to claim 1, including adjustable speed fans for supplying air to said nozzles to adjust for frictional forces said guide surface member exerts on the sheets.

6. Device according to claim 1, wherein the respective nozzles are switchable between a suction-air mode and a blast mode by remote control of a reversible fan.

7. Device according to claim wherein the nozzles in said entry region of the guide surface member are switchable to the suction-air mode by said reversible fan when the printing material being processed requires a change in the frictional force between the sheets and said guide surface for reliably feeding the sheets.

8. Device according to claim 6 wherein said nozzles in said exit region of said guide surface member are switchable to the suction-air mode by said reversible fan when the printing material being processed requires a change in the frictional force between the sheets and said guide surface for reliably feeding the sheets.

9. Device according to claim 1, wherein the respective nozzles are switchable to suction-air mode by a reversible fan for sucking a respective sheet in a region of said guide surface located substantially centrally to a sheet guide path in one of said entry region and said exit region.

10. Device according to claim 9, wherein the printing press is operable for processing a sheet with a width of a given minimal format and said substantially central region of said guide surface has a width smaller than the width of the given minimal format processable by the printing press.

* * * * *